US010286670B2

(12) United States Patent
Hollands et al.

(10) Patent No.: US 10,286,670 B2
(45) Date of Patent: May 14, 2019

(54) INK HANDLING UNIT AND INK JET IMAGING DEVICE COMPRISING SUCH INK HANDLING UNIT

(71) Applicant: Océ-Technologies B.V., Venlo (NL)

(72) Inventors: Peter J. Hollands, Venlo (NL); Jacob A. Westdijk, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/830,466

(22) Filed: Dec. 4, 2017

(65) Prior Publication Data

US 2018/0086089 A1 Mar. 29, 2018

Related U.S. Application Data

(63) Continuation of application No. PCT/EP2016/062220, filed on May 31, 2016.

(30) Foreign Application Priority Data

Jun. 4, 2015 (EP) ..... 15170641

(51) Int. Cl.
*B41J 2/175* (2006.01)
*B41J 29/377* (2006.01)

(52) U.S. Cl.
CPC ..... *B41J 2/17513* (2013.01); *B41J 2/175* (2013.01); *B41J 2/17566* (2013.01); *B41J 29/377* (2013.01)

(58) Field of Classification Search
CPC .... B41J 2/17513; B41J 2/17566; B41J 2/175; B41J 29/377
See application file for complete search history.

(56) References Cited

U.S. PATENT DOCUMENTS 6,280,013 B1 * 8/2001 Wade ..... B41J 2/1408 347/17
6,607,259 B2 * 8/2003 Mott ..... B41J 2/1408 347/18
7,448,736 B2 * 11/2008 Hong ..... B41J 2/17593 347/85
2003/0071865 A1 4/2003 Mott et al.
2010/0066785 A1 3/2010 Yamada et al.

FOREIGN PATENT DOCUMENTS

EP 1688260 A2 8/2006
WO WO 2009/047503 A1 4/2009

OTHER PUBLICATIONS

International Search Report, issued in PCT/EP2016/062220, PCT/ISA/210, dated Jul. 5, 2016.
Written Opinion of the International Searching Authority, issued in PCT/EP2016/062220, PCT/ISA/237, dated Jul. 5, 2016.

* cited by examiner

*Primary Examiner* — Huan H Tran
(74) *Attorney, Agent, or Firm* — Birch, Stewart, Kolasch & Birch, LLP

(57) ABSTRACT

An ink handling unit includes an ink reservoir with an integrated heat exchange channel configured for pre-heating or pre-cooling an ink feed flow entering the ink reservoir via the heat exchange channel. The heat exchange channel is in direct thermal contact with an interior space of the ink reservoir. An ink jet imaging device includes the ink handling unit. Such imaging devices are suitable to be used in highly productive ink jet processes at elevated temperatures.

14 Claims, 4 Drawing Sheets

INK HANDLING UNIT AND INK JET IMAGING DEVICE COMPRISING SUCH INK HANDLING UNIT

CROSS-REFERENCE TO RELATED APPLICATIONS

This application is a Continuation of PCT International Application No. PCT/EP2016/062220, filed on May 31, 2016. PCT/EP2016/062220 claims priority under 35 U.S.C. § 119 to Application No. 15170641.3, filed in Europe on Jun. 4, 2015. The entirety of each of the above-identified applications is expressly incorporated herein by reference.

BACKGROUND OF THE INVENTION

1. Field of the Invention

The present invention relates to an ink handling unit suitable to be used in an ink jet imaging device.

2. Background of the Invention

Ink jet imaging devices are known in the background art. For example, thermal ink jet imaging devices (bubble jet) are known in particular in aqueous ink jet printing, such as in home and office printers. Piezo ink jet imaging devices are known in, e.g. aqueous ink jet printing, solvent ink jet printing, UV curable ink jet printing and hot melt ink jet printing.

It is also known in the background art that ink jet imaging devices may comprise an ink reservoir for holding a small amount of conditioned ink, i.e. the ink is conditioned to satisfy jetting criteria, e.g. the ink may be filtered and brought to a jetting temperature for the particular ink.

A disadvantage of the known imaging devices is that with increasing printing productivity requirements, ink demands of a single ink jet imaging device may increase significantly, such that conditioning of the ink to jetting conditions, in particular slowness of temperature control, may limit the maximum printing productivity of the imaging device.

It is known in the background art to use external (i.e. outside the imaging device) heat exchangers for pre-heating fresh ink prior to feeding the ink to an ink jet imaging device, by bringing the fresh ink into thermal contact with already conditioned (heated) ink. A known way of realizing this is to use an ink jet imaging device in a through-flow mode, such that a certain flow of ink can be circulated through the ink jet imaging device independent of the amount of ink being jetted. The circulation flow of ink is brought into thermal contact with fresh ink by means of an external heat exchanger.

A disadvantage of the above described configuration is that additional external (outside the imaging device) equipment is required and additional fluid connections need to be established. Also, the above configuration may become rather complex and, due to the increased number of fluid connections, prone to leaks.

The circulation flow of ink through the ink jet imaging device comprises conditioned ink. It is therefore another disadvantage of the above configuration that a relatively large amount of ink (i.e. large amount relative to the amount of ink being jetted) needs to be conditioned, before printing can be started. Start-up after shut-down of the printing system may therefore require a relatively long time. Another disadvantage is that temperature conditioning of the relatively large volume of circulating ink is inefficient and prone to energy losses. In order to prevent or mitigate energy losses, additional thermal insulation may need to be installed.

SUMMARY OF THE INVENTION

It is therefore an object of the present invention to solve or at least mitigate the above stated disadvantages and therefore to provide an ink handling unit suitable to be used in an ink jet imaging device and suitable to be used for high productive ink jet processes performed at elevated temperatures in an (energy) efficient way.

In a first aspect of the present invention, the object is at least partly achieved by providing an ink handling unit comprising an ink reservoir with an integrated heat exchange channel configured for pre-heating or pre-cooling an ink feed flow entering the ink reservoir via the heat exchange channel, wherein the heat exchange channel is in direct thermal contact with an interior space of the ink reservoir.

According to an embodiment of the present invention, in operation, the ink reservoir is at least partly filled with ink, and the integrated heat exchange channel operates as a feed channel to the ink reservoir. A wall of the integrated heat exchange channel is also a wall of the ink reservoir, such that heat exchange between the ink that flows through the integrated heat exchange channel and the ink present in the internal space of the ink reservoir occurs via said wall. Said wall may be composed of one or more (layers of) heat conducting materials. Direct thermal contact further implies that the wall does not comprise active heating elements, such that heat transfer between the ink flowing through the heat exchange channel and the ink present in the interior space of the ink reservoir only comprises passive heat transfer via said wall and caused by the temperature difference (which is a driving force for heat transfer) between the ink flowing through the integrated heat exchange channel and the ink present in the interior space of the ink reservoir. Active heaters and/or coolers (and temperature sensors) may be present elsewhere in the ink reservoir in order to control the temperature of the ink present in the interior space of the ink reservoir (bulk ink).

With the integrated heat exchange channel, fresh ink having a temperature different from the temperature of the ink present in the interior space of the ink reservoir may be pre-heated (or pre-cooled) in order to decrease the temperature difference between the ink entering the interior space of the ink reservoir (i.e. fresh ink) and the ink already present in the interior space of the ink reservoir (i.e. bulk ink). Temperature control of the ink present in the interior space of the ink reservoir (i.e. bulk ink) becomes much easier, because upon an increase of the ink demand, the temperature of the bulk ink will change more gradually, demanding a gradual temperature control action, reducing the risk of overshooting or undershooting control actions. Temperature control of the bulk ink becomes much faster. Furthermore, because the temperature difference between the fresh ink entering the interior space of the ink reservoir and the bulk ink is decreased due to the fact that heat exchange between fresh ink and bulk ink occurs (because the ink passes through the integrated heat exchange channel) prior to entering the interior space of the ink reservoir, a high temperature uniformity may be obtained in the bulk ink present in interior space of the ink reservoir.

The ink handling unit according to the present invention enables a compact layout comprising a lightweight reservoir and promotes fast temperature conditioning (heating or cooling) of the ink with minimal power.

In an embodiment, the integrated heat exchange channel is at least partly arranged in a first wall of the ink reservoir.

In an embodiment, the ink handling unit according to the present invention comprises an ink inlet port in fluid connection with an entry side of the integrated heat exchange channel.

In an embodiment, the integrated heat exchange channel comprises an outlet side arranged in fluid connection with the interior space of the ink reservoir.

In an embodiment, the ink handling unit according the present invention comprises an ink outlet port in fluid connection with the interior space of the ink reservoir. The ink outlet port is preferably arranged at the lowest position of the ink reservoir, such that in operation the ink can flow out of the ink reservoir under the influence of gravity.

In an embodiment, the ink handling unit according to the present invention comprises an insert element configured for being arranged inside the interior space of the ink reservoir, and wherein a first part of the integrated heat exchange channel is arranged in the first wall of the ink reservoir and a second part of the integrated heat exchange channel is arranged in a first side of a wall of the insert element such that in an assembled state the first side of the wall of the insert element faces the first wall of the ink reservoir to form the integrated heat exchange channel.

An additional advantage of the present embodiment is that, because the total integrated heat exchange channel is enclosed by the ink reservoir. if the integrated heat exchange channel is not completely ink tight, the ink only leaks from the integrated heat exchange channel into the interior space of the ink reservoir. Another additional advantage of the present embodiment is that no additional seals are required, because the integrated heat exchange channel is completely enclosed by the ink reservoir.

By machining the first part of the integrated heat exchange channel in the first wall of the ink reservoir and the second part in the first side of the wall of the insert element, the manufacturing of both parts (ink reservoir and insert element) is relatively simple, because both parts forming the heat exchange channel can be machined in an outer surface of the first wall of the ink reservoir and in an outer surface of the wall of the insert element, respectively.

In an embodiment, the insert element comprises a plurality of protrusions arranged on a second side of the wall of the insert element, the second side being arranged opposite to the first side of the wall of the insert element.

The protrusions may have two functions:

a) the protrusions act as baffles promoting mixing of fresh ink and bulk ink. The design and orientation of the protrusions is such that the ink is brought in the corners of the ink reservoir thus minimizing the dead volume in the ink reservoir and such that direct flow of fresh ink towards the ink exit port is prevented or at least mitigated; and b) the protrusions act as heat fins, promoting heat transport from the interior space of the ink reservoir towards the wall of the insert element (which in turn is in thermal contact with the integrated heat exchange channel) and towards a lid (see embodiment(s) below) contributing to improved temperature uniformity of the bulk ink.

Therefore, the protrusions enable fast and uniform heating of the ink.

In an embodiment, the ink reservoir comprises a second wall arranged substantially perpendicular to the first wall, wherein the ink handling unit comprises a lid configured for enclosing and sealing the interior space of the ink reservoir The second wall is preferably an endless wall (i.e. the second wall forms a circumference of the interior space) having a certain height substantially perpendicular to the first wall. The lid is preferably arranged on top of the second wall and opposite the first wall, such that, in an assembled state, the interior space of the ink reservoir is enclosed by the first wall, the second wall and the lid.

In an embodiment, the lid comprises or accommodates a level sensor, preferably a capacitive level sensor. Preferably, the level sensor covers a substantial part of the lid.

An additional advantage of a capacitive level sensor covering a large area of the lid is that due to the large sensor area, the sensor is less prone to disturbances and noise.

The protrusions as discussed above promote heat transport towards the lid and hence towards the (capacitive) level sensor. In this way temperature uniformity of the ink present near the lid (and the bulk ink as a whole) and hence the level sensor may be improved, which enables proper working of the level sensor or at the least improves its accuracy.

In an embodiment, the ink handling unit according to the present invention comprises a controller configured for controlling the temperature of at least the interior space of the ink reservoir.

In an embodiment, the controller comprises a temperature sensor and a heater.

In another aspect, the present invention pertains to an ink jet imaging device comprising the ink handling unit according to the first aspect of the present invention of which embodiments are disclosed above.

In an embodiment, the ink jet imaging device according to the present invention comprises a drop forming unit in fluid connection with the ink handling unit.

Therefore, an embodiment of the present invention pertains to:

1. An ink handling unit comprising an ink reservoir with an integrated heat exchange channel configured for pre-heating or pre-cooling an ink feed flow entering the ink reservoir via the heat exchange channel, wherein the heat exchange channel is in direct thermal contact with an interior space of the ink reservoir, wherein the ink handling unit comprises an insert element configured for being arranged inside the interior space of the ink reservoir, and wherein a first part of the integrated heat exchange channel is arranged in the first wall of the ink reservoir as a first trench and a first side of a wall of the insert element is arranged such that in an assembled state the first side of the wall of the insert element faces the first wall of the ink reservoir forming a lid on top of the first trench and hence forming the integrated heat exchange channel;
2. The ink handling unit according to 1, wherein a second part of the integrated heat exchange channel is arranged in the first side of the wall of the insert element as a second trench such that in an assembled state the first side of the wall of the insert element faces the first wall of the ink reservoir and the first trench and the second trench form the integrated heat exchange channel;
3. The ink handling unit according to any one of 1-2, further comprising an ink inlet port in fluid connection with an entry side of the integrated heat exchange channel;
4. The ink handling unit according to any one of 1-3, wherein the integrated heat exchange channel comprises an outlet side arranged in fluid connection with the interior space of the ink reservoir;

5. The ink handling unit according to any one of 1-4, further comprising an ink outlet port in fluid connection with the interior space of the ink reservoir;
6. The ink handling unit according to 5, wherein the insert element comprises a plurality of protrusions arranged on a second side of the wall of the insert element, the second side being arranged opposite to the first side of the wall of the insert element;
7. The ink handling unit according to any one of 1-6, wherein the ink reservoir comprises a second wall arranged substantially perpendicular to the first wall, and wherein the ink handling unit comprises a lid configured for enclosing and sealing the interior space of the ink reservoir;
8. The ink handling unit according to 7, wherein the lid comprises or accommodates a level sensor;
9. The ink handling unit according to 8, wherein the level sensor comprises a capacitive level sensor;
10. The ink handling unit according to any one of 1-9, further comprising a controller configured for controlling the temperature of at least the interior space of the ink reservoir;
11 The ink handling unit according to 10, wherein the controller comprises a temperature sensor and a heater;
12. An ink jet imaging device comprising the ink handling unit according to any one of 1-11; and
13. The ink jet imaging device according to 12, further comprising a drop forming unit in fluid connection with the ink handling unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2A-2D are schematic representations of an insert element being a part of an ink handling unit in accordance with an embodiment of the present invention, wherein FIG. 2A is a front view, FIG. 2B is a rear view, FIG. 2C is a top view, and FIG. 2D is a side view of a cross section of the insert element.

FIGS. 3A-3C are 3D representations of an ink handling unit according to an embodiment of the present invention, wherein FIG. 3A is a front view, FIG. 3B is a rear view, and FIG. 3C is a front view in an assembled state, including a drop forming unit.

DETAILED DESCRIPTION OF THE PREFERRED EMBODIMENTS

Figure 1:
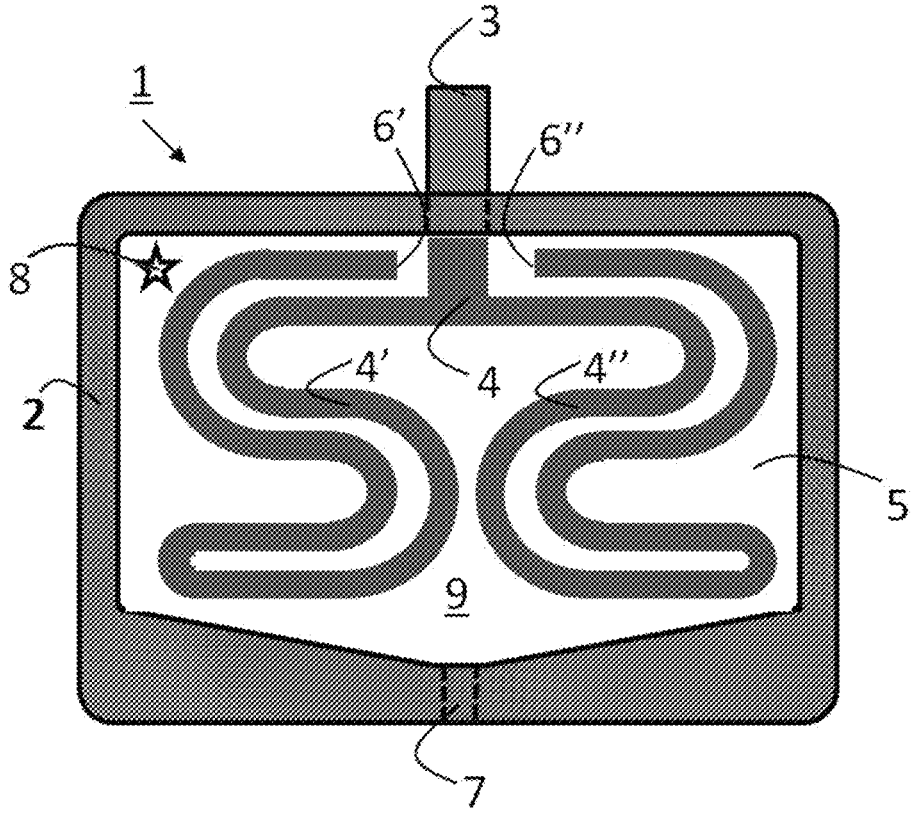
FIG. 1 is a schematic representation of an ink reservoir being a part of an ink handling unit in accordance with an embodiment of the present invention.

The present invention will now be described with reference to the accompanying drawings, wherein the same or similar elements are identified with the same reference numeral.

FIG. 1 is a schematic representation of an ink reservoir 1 being a part of an ink handling unit in accordance with an embodiment of the present invention. The ink reservoir comprises a first wall 5 and a second wall 2. A first trench 4 is machined in the first wall 5, such that the trench 4 bifurcates into two meandering sub-trenches 4' and 4", respectively. Both sub-trenches 4' and 4" have endings, represented by 6' and 6". The ink reservoir 1 comprises an ink inlet port 3 associated with trench 4 and an ink outlet port 7 associated with the interior space 9 of the ink reservoir 1. The star 8 is used to reference the orientation of the ink reservoir 1.

FIGS. 2A-2D are schematic representations of an insert element 20 being a part of an ink handling unit in accordance with an embodiment of the present invention.

Figure 2C:
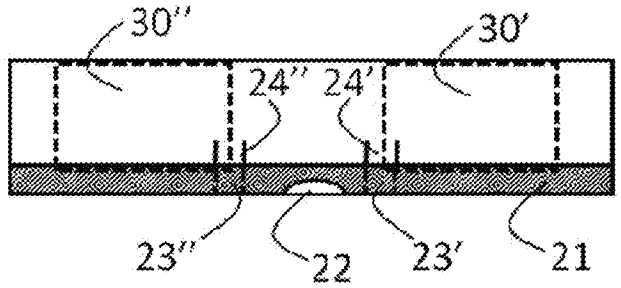
Figure 2B:
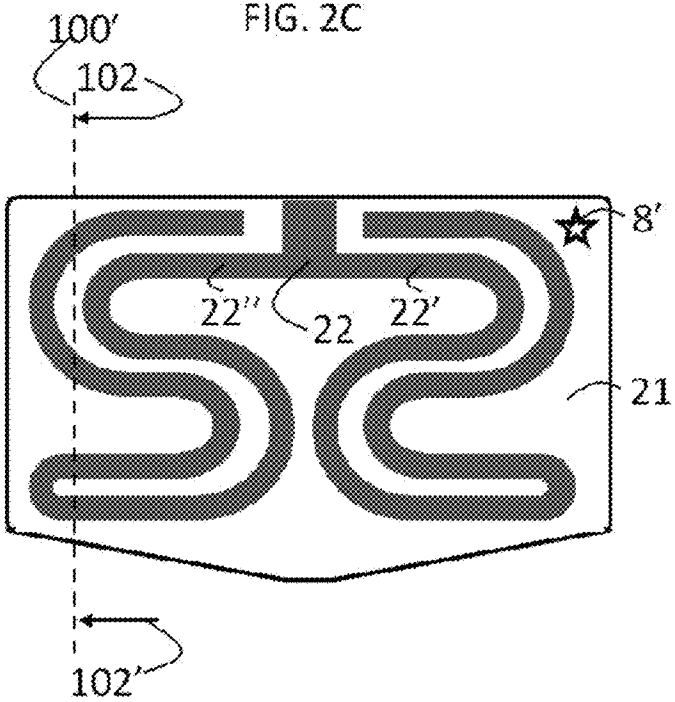

FIG. 2B is a rear view of the insert element 20. The insert element comprises a wall 21 and a second trench 22 machined in the wall 21. The second trench 22 bifurcates into two meandering sub-trenches 22' and 22". The second trench 22 is a mirror image of the first trench 4, shown in FIG. 1. When assembled, the insert element is placed in the interior space 9 of the ink reservoir 1, such that star 8' in FIG. 2B faces star 8 in FIG. 1, and the first trench 4 and the second trench 22 form an integrated heat exchange channel. The entry side of the heat exchange channel (not shown) is in fluid connection with the ink inlet port 3.

FIG. 2C is a top view of the insert element 20. FIG. 2C shows the second trench 22 machined in the wall 21 and through holes 23' and 23" through wall 21. The through holes 23' and 23" are in fluid connection with the exit sides of sub-trenches 22' and 22", respectively, and the ink channels 24' and 24", respectively. FIG. 2C further shows a projection of protrusions 30' and 30" associated with the front side of the insert element 20.

Figure 2A:
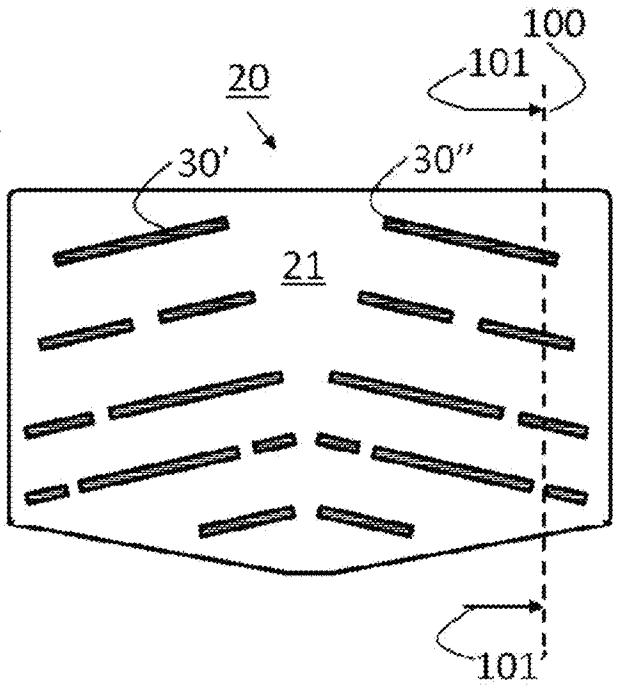

FIG. 2A is a front view of the insert element. The insert element comprises a plurality of protrusions of which the top two are indicated with 30' and 30". The protrusions are associated with wall 21. The protrusions may have two functions: a) the protrusions act as mixing promoters (baffles) of the ink fed to the ink reservoir 1 with the ink already present in the interior space 9 of the ink reservoir 1; and b) the protrusions act as heat fins, promoting heat exchange between the interior space 9 of the ink reservoir and the integrated heat exchange channel. For this latter function, it is evident that the materials used for at least the insert element preferably are materials having good heat conducting properties, such that good heat transfer between the interior space 9 of the ink reservoir and the integrated heat exchange channel may be established. Preferably, the heat conductivity of the insert element is higher than the heat conductivity of the ink. In this case, the heat exchange between the bulk ink and the fresh ink is not limited by the heat transport through the protrusions and wall 21 of the insert element.

Figure 2D:
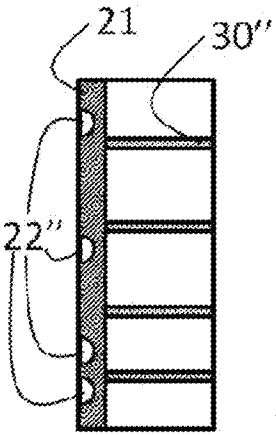

FIG. 2D is a side view of a cross section of the insert element 20, the cross section being taken at intermitting lines 100 and 100' as shown in FIGS. 2A and 2B, respectively. Arrows 101, 101' (FIG. 2A) and 102, 102' (FIG. 2B) represent the viewing direction.

FIG. 2D shows a plurality of cross sections of the second trench 22 machined in a first side of wall 21. FIG. 2D further shows a plurality of protrusions (of which the top one is indicated with 30"), protruding from a second side of wall 21, the second side being opposite to the first side.

As stated above, the ink handling unit is assembled by inserting the insert element 20 into the interior space 9 of the ink reservoir 1, such that star 8' in FIG. 2B faces the star 8 in FIG. 1. The sub-assembly comprising the ink reservoir 1 and the insert element 20 is then closed and sealed with a lid (not shown). The lid may be permanently fixed for example by gluing or welding the lid onto the second wall 2 of the ink reservoir 1 such that the lid is arranged in parallel with the second wall 5. However, preferably the lid is reversibly fixed for example by screwing or clamping it to the ink reservoir 1. Reversible fixing of the lid is preferred because of better serviceability of the ink handling unit. After assembling, the assembly comprises an ink reservoir 1, an insert element 20 and a lid (not shown). In the assembled state, the first side of wall 21 of the insert element 20 is forced against the first wall 5 of the ink reservoir 1, such that the first trench 4 and the second trench 22 form an integrated heat exchange channel, which is in fluid connection with the ink entry port 3 and with ink channels 24' and 24", both ending in the interior space 9 of the ink reservoir 1.

In operation, a certain amount of ink having a first temperature T1 is present in the interior space 9 comprising the insert element 20. The amount of ink present in the interior space of the ink reservoir is also termed bulk ink. Fresh ink having a second temperature T2 being different from the first temperature T1 is fed to the ink handling unit via ink inlet port 3 and flows through the integrated heat exchange channel as described above. The heat exchange channel is in direct thermal contact with the interior space 9 of the ink reservoir 1, hence in direct thermal contact with the bulk ink. In case T1>T2, the freshly fed ink will be pre-heated by the bulk ink. In case T1<T2, the freshly fed ink will be cooled by the bulk ink.

Figure 3A:
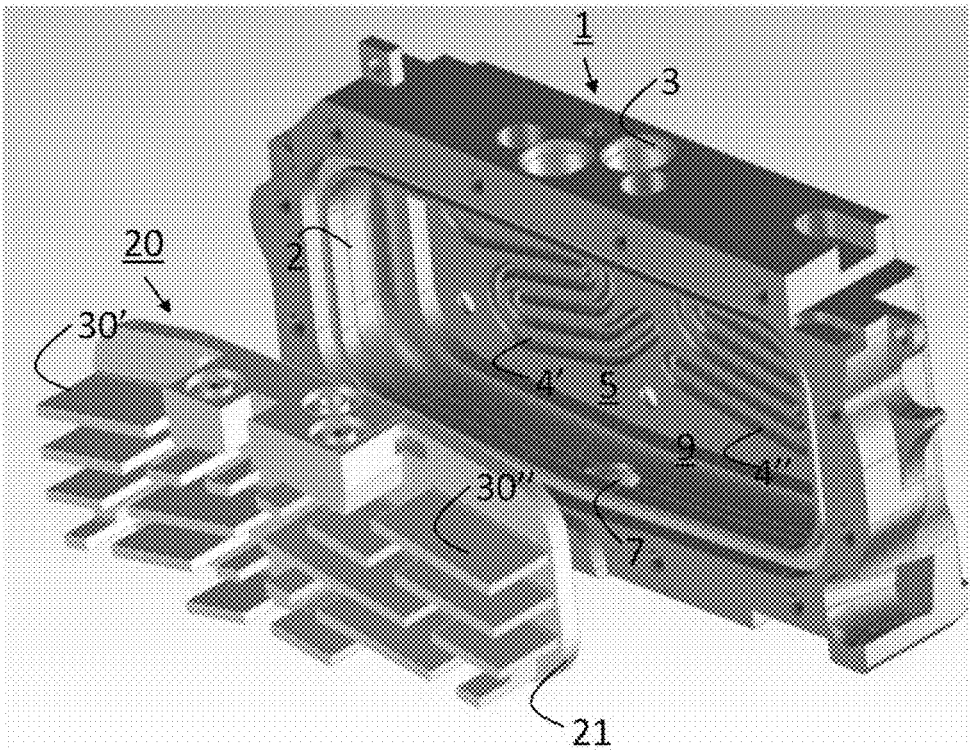
Figure 3B:
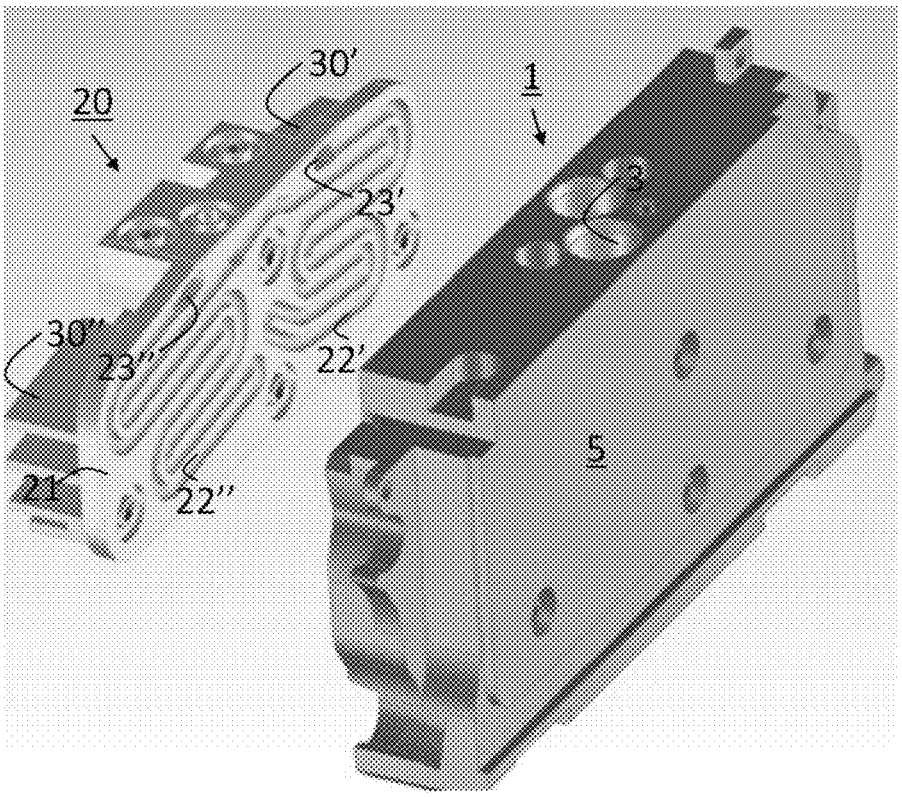
Figure 3C:
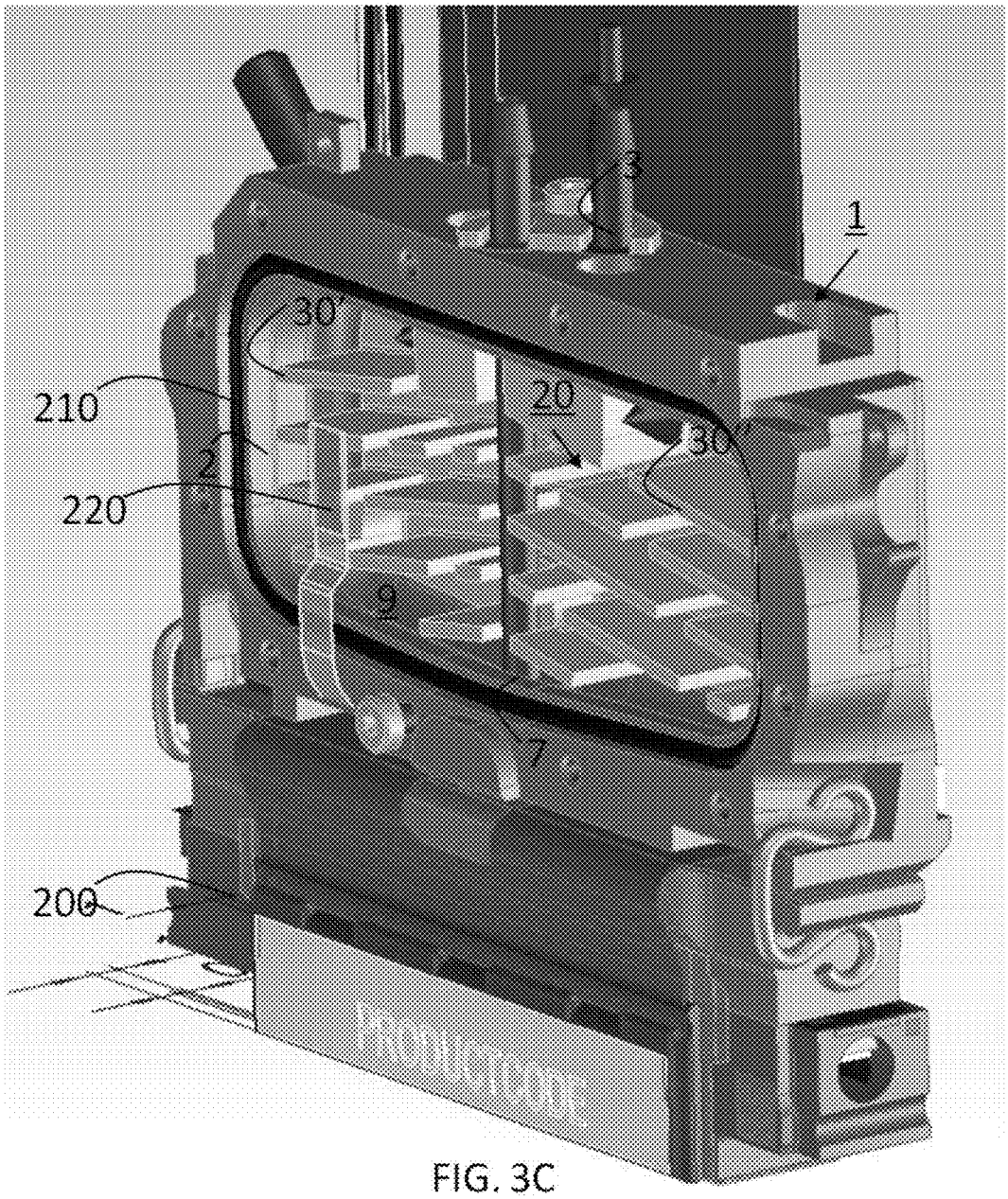

FIGS. 3A-3C are 3D representations of an ink handling unit according to an embodiment of the present invention. The shown embodiment is similar to the embodiment shown in FIGS. 2A-2D, therefore the numbering of similar elements in FIGS. 3A-3C is identical to the corresponding elements shown in FIGS. 2A-2D.

FIGS. 3A and 3B, respectively, are a front view and a rear view of an ink reservoir 1 and an insert element 20 in an orientation relative to each other in which they are to be assembled. FIG. 3A shows the two sub-trenches 4' and 4" into which the first trench 4 (FIG. 1) bifurcates and FIG. 3B shows the second trench 22 bifurcating into two sub-trenches 22' and 22", which after assembling form the integrated heat exchange channel. The through-holes 23' and 23", which fluidly connect the integrated heat exchange channel with the interior space 9 of the ink reservoir 1 are shown in FIG. 3B. FIG. 3A shows the plurality of protrusions of which two are indicated with 30' and 30" and which correspond to the protrusions shown in FIGS. 2A, 2C and 2D.

FIG. 3C is a front view of in imaging device comprising a drop forming unit 200 and the ink handling unit according to the present invention in a sub-assembled state. A complete assembly would also comprise a lid for closing and sealing the interior space 9 of the ink reservoir 1. FIG. 3C shows a sealing member 210, which may be an endless element (e.g. an O-ring) of a compliant material (such as rubber, EPDM or the like, being selected to be resistant to the materials used in the ink composition). FIG. 3C shows a connector for electrically connecting a level sensor, preferably a capacitive level sensor.

In a capacitive level sensing method, a sensor forms one capacitor plate (isolated from the ink, which may be realized by providing a polyimide foil as a lid to which the sensor is attached) and the ink reservoir 1 forms the other capacitor plate. Depending on the degree of filling of the ink reservoir 1 with ink, the capacitance (or other suitable signal, such as impedance) varies. The level sensor can be calibrated with respect to known ink volumes. There are various possible layouts to enable calibration and use of capacitive level sensing.

For the capacitive level sensor to be working adequately and accurately, high temperature uniformity of the ink present in the ink reservoir 1 is at least desired and may be required. The plurality of protrusions may contribute to the temperature uniformity by promoting mixing of fresh (pre-heated) ink with bulk ink. The plurality of protrusions also promote heat transfer to the lid of the ink handling unit and hence to the (capacitive) level sensor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink handling unit, comprising:

an ink reservoir with an integrated heat exchange channel configured for pre-heating or pre-cooling an ink feed flow entering the ink reservoir via the integrated heat exchange channel, wherein the integrated heat exchange channel is in direct thermal contact with an interior space of the ink reservoir.

2. The ink handling unit according to claim 1, wherein the integrated heat exchange channel is at least partly arranged in a first wall of the ink reservoir.

3. The ink handling unit according to claim 1, further comprising an ink inlet port in fluid connection with an entry side of the integrated heat exchange channel.

4. The ink handling unit according to claim 1, wherein the integrated heat exchange channel comprises an outlet side arranged in fluid connection with the interior space of the ink reservoir.

5. The ink handling unit according to claim 1, further comprising an ink outlet port in fluid connection with the interior space of the ink reservoir and configured to communicate with a drop forming unit.

6. The ink handling unit according to claim 1, further comprising an insert element configured for being arranged inside the interior space of the ink reservoir, wherein a first part of the integrated heat exchange channel is arranged in the first wall of the ink reservoir and a second part of the integrated heat exchange channel is arranged in a first side of a wall of the insert element such that, in an assembled state, the first side of the wall of the insert element faces the first wall of the ink reservoir to form the integrated heat exchange channel.

7. The ink handling unit according to claim 6, wherein the insert element comprises a plurality of protrusions arranged on a second side of the wall of the insert element, the second side being arranged opposite to the first side of the wall of the insert element.

8. The ink handling unit according to claim 1, wherein the ink reservoir comprises a second wall arranged substantially perpendicular to the first wall, and wherein the ink handling unit further comprises a lid configured for enclosing and sealing the interior space of the ink reservoir.

9. The ink handling unit according to claim 8, wherein the lid comprises or accommodates a level sensor.

10. The ink handling unit according to claim 9, wherein the level sensor comprises a capacitive level sensor.

11. The ink handling unit according to claim 1, further comprising a controller configured for controlling the temperature of at least the interior space of the ink reservoir.

12. The ink handling unit according to claim 11, wherein the controller comprises a temperature sensor and a heater.

13. An ink jet imaging device comprising the ink handling unit according to claim 1.

14. The ink jet imaging device according to claim 13, further comprising a drop forming unit in fluid connection with the ink handling unit.

* * * * *